US007794551B1

(12) United States Patent
Imbrogno et al.

(10) Patent No.: US 7,794,551 B1
(45) Date of Patent: Sep. 14, 2010

(54) CARBURIZATION OF METAL ARTICLES

(75) Inventors: Peter G. Imbrogno, Dubois, PA (US); John C. Kosco, St. Marys, PA (US)

(73) Assignee: Keystone Investment Corporation, Wilmington, DE (US)

( * ) Notice: Subject to any disclaimer, the term of this patent is extended or adjusted under 35 U.S.C. 154(b) by 360 days.

(21) Appl. No.: 11/302,890

(22) Filed: Dec. 14, 2005

(51) Int. Cl.
*C23C 8/00* (2006.01)
*C22C 22/00* (2006.01)

(52) U.S. Cl. ..... 148/209; 148/316

(58) Field of Classification Search ..... 419/57; 148/209, 316; *C10M 3/04*
See application file for complete search history.

(56) References Cited

FOREIGN PATENT DOCUMENTS

GB 2058128 A * 4/1981

OTHER PUBLICATIONS

Katsamas et al. ("Laser-Beam Carburizing of Low Alloy Steels", Surface and Coating Technology, 139(2001) 183-191).*

Paul G. Shewmon et al, *Transformations in Metals*, Chapter 2-4, pp. 41-46, 1969.

O. Rey and P. Jacquot, "Kolsterising: Hardening of Austenitic Stainless Steel" (*Surface Engineering*, 2002 vol. 18, No. 6, pp. 412-414).

http://en.wikipedia.org/wiki/Carburization, Aug. 14, 2005.

* cited by examiner

*Primary Examiner*—Roy King
*Assistant Examiner*—Weiping Zhu
(74) *Attorney, Agent, or Firm*—Alvin T. Rockhill; Edwin A. Sisson

(57) ABSTRACT

The present invention relates to a process for carburizing a metal article comprising: (1) heating the metal article to an elevated temperature, (2) coating the heated metal article with a graphite suspension to produce a graphite coated metal article, wherein the graphite suspension is comprised of graphite and an organic or inorganic liquid having a boiling point of at least 50° F. (28° C.) less than the elevated temperature to which the metal article is heated, (3) heat treating the graphite coated metal article under a non-oxidizing environment at a temperature which is sufficient to promote the diffusion of carbon into the metal structure of the article to produce a carburized metal article, and (4) cooling the carburized metal article to ambient temperature.

20 Claims, No Drawings

CARBURIZATION OF METAL ARTICLES

BACKGROUND OF THE INVENTION

Carburization is a process through which carbon is added to the surface of metal articles. It is carried out by exposing the metal article to a carbon rich environment and maintaining the article at a temperature that allows for diffusion to transfer carbon atoms into the metal which is typically steel. This temperature will be sufficient to maintain the steel as austenite that has a face-centered cubic structure and which has a high solubility for carbon. The carburization will typically be carried out until the carbon content of the steel has been increased to the desired level which will typically be between about 0.5% and 1%. Hardening of the high-carbon surface layer of the steel article is then accomplished by quenching the article to form martensite having enhanced hardness and wear resistance.

It is often desirable to carburize the surface of articles to improve hardness and wear resistance without compromising the strength or toughness of the underlying steel in the article. For instance, it is normally desirable to carburize the outer surface of gears to improve wear resistance while maintaining the strength of the steel in the body of the gear. In such a scenario, a medium-carbon or low-carbon steel can be used in making a gear which is carburized to increase the carbon content of only its surface.

Historically, carburization was initially performed by simply packing the steel part in a carbon powder in a suitable container and maintaining it at an elevated temperature for a time period which was sufficient to allow the carbon to diffuse into the steel article. This technique, known as pack carburization, was later improved by packing the steel part in charcoal granules that were treated with an activating chemical, such as barium carbonate ($BaBO_3$). In this improved pack carburizing process, the activating chemical promotes the formation of carbon dioxide which in turn reacts with excess carbon in the charcoal to produce carbon monoxide. The carbon monoxide then reacts with the low-carbon steel surface of the article to form carbon atoms that diffuse into the steel. This increases the carbon content of the steel near the outer surface of the metal article, but does not, as is the case with all carburization procedures, increase the hardness of the steel. Accordingly, the metal article is subsequently quenched to attain the desired level of hardness. Pack carburization is an extremely effective method of increasing the carbon content near the surface of metal parts. However, pack carburization is a very slow, time consuming process. Attaining uniform and consistent results is another problem frequently encountered when utilizing pack carburization.

Over the years, a number of improved techniques for carburizing steel articles have been developed. These techniques include gas carburizing, plasma carburizing, salt bath carburizing and liquid carburizing. Gas carburization involves heating the steel article being treated to a temperature above about 1,550° F. (843° C.) to form austenite and maintaining the article at that temperature in a carburizing gas atmosphere for a time that is sufficient to increase the carbon content near the surface of the article to the desired level. The time required for the carbon to diffuse into the steel will typically vary from about four hours to about ten hours. The carburizing gas atmosphere will typically be a mixture of hydrogen and methane in an inert gas or a mixture of carbon monoxide and carbon dioxide in an inert gas. In the first case, the hydrogen/methane ratio and in the second case the carbon monoxide/carbon dioxide ratio is adjusted to give the desired carbon concentration on the surface of the steel being treated. Uniform results can be attained by carefully controlling the ratio of reactive gases and the carburization temperature. Gas carburizing leads to a uniform result with carbon being diffused consistently over the surface of the metal part being treated. However, gas carburization is a time consuming and expensive procedure.

Vacuum carburization utilized a single-component atmosphere consisting solely of a simple hydrocarbon in a gaseous state, such as methane. Vacuum carburization is carried out at low pressure under an oxygen-free environment and offers the advantage of being able to utilize higher carburization temperatures without the risk of surface or grain-boundary oxidation. This, in turn, leads to higher levels of carbon solubility in the austenite formed and to increased rates of carbon diffusion. The time required to attain the desired carbon level at the surface of the part is accordingly reduced.

Even though vacuum carburization eliminates some of the complexities of gas carburization, it is not universally applicable to the treatment of all metal parts. This is because the rate of flow of the carburizing gas into deep recesses in the part is quickly depleted at the low gas pressures used. This leads to an insufficient level of carbon penetration in the steel at such recesses in the structure of the part. Thus, the treated part will not have the desired level of hardness and wear resistance at such points on the surface of the part. It should be noted that this problem typically cannot be overcome by simply increasing the pressure of the carburizing gas because sooting usually results in such a scenario.

In plasma carburization, carbon ions are given a positive charge and the steel part being carburized is provided with a negative charge and acts as the cathode to which the positively charged carbon ions are drawn. Plasma carburization rapidly introduces carbon into the surface of the part and also provides fast diffusion kinetics. Plasma carburization also offers the advantage of providing a very uniform carburization of the part even in cases where the part has deep recesses or other surface irregularities which are difficult to carburize using gas or vacuum carburization techniques. However, plasma carburization is expensive and requires sophisticated equipment.

Salt bath carburization involves immersing the steel part in a molten carbon rich salt bath. Such salt baths traditionally use cyanide as a major component of the carbon rich bath. Safety concerns have limited salt bath carburization procedures from coming into widespread utilization. Additionally, salt bath carburization requires relatively expensive specialized equipment.

In liquid carburization, a liquid hydrocarbon is employed as the source of carburizing gas. The liquid hydrocarbon can be an aliphatic or an aromatic hydrocarbon such as hexane, cyclohexane, benzene, or toluene. Oxygenated hydrocarbons such as alcohols, glycols, and ketones are also commonly used as the liquid hydrocarbon source. In such liquid hydrocarbon carburization procedures, the liquid hydrocarbon is fed into a carburization furnace containing the steel part or parts being carburized and volatilizes almost instantaneously at the temperature of the furnace. The vapors of the liquid hydrocarbon source dissociate thermally to provide a carburizing atmosphere that typically contains carbon monoxide, carbon dioxide, methane and other lower alkanes. In the case of oxygenated hydrocarbons water vapor is also typically produced. The flow of the liquid hydrocarbon source into the furnace is adjusted to accurately attain the desired level of carburization. However, liquid hydrocarbon carburization is a slow process which makes it capital intensive and expensive.

There is a need for a carburization technique that leads to uniform results and which can be carried out quickly on a cost effective basis. However, no conventional carburization procedure offers all of these benefits.

SUMMARY OF THE INVENTION

The carburization procedure of this invention can be used to quickly carburize the surface of a steel part. It does not require any sophisticated equipment and can be carried out in a very cost effective manner. In fact, the procedure of this invention can be used to carburize steel parts at a very low relative cost from a standpoint of both fixed and variable costs.

The present invention more specifically discloses a process for carburizing a metal article comprising: (1) heating the metal article to an elevated temperature, (2) coating the heated metal article with a graphite suspension to produce a graphite coated metal article, wherein the graphite suspension is comprised of graphite and an organic or inorganic liquid having a boiling point of at least 50° F. (28° C.) less than the elevated temperature to which the metal article is heated, (3) heat treating the graphite coated metal article under a non-oxidizing environment at a temperature which is sufficient to promote the diffusion of carbon into the metal structure of the article to produce a carburized metal article, and (4) cooling the carburized metal article to ambient temperature.

DETAILED DESCRIPTION OF THE INVENTION

The carburization technique of this invention is applicable to virtually any type of metal part. However, carburization is only needed in cases where the steel being treated has a relatively low carbon content. In other words, there is no need to carburize the surface of high carbon steels which already have a high carbon content throughout their entire structure. Generally, increasing the carbon content of a steel to levels of higher than about 0.5% does not enhance the hardenability of the steel. Accordingly, the steel parts carburized by the technique of this invention will typically have an initial carbon content of less than 0.5% and will more typically have initial carbon contents which are within the range of 0.1 to about 0.3 weight percent. The carburization technique of this invention is used to increase the carbon content near the surface of such articles to a higher level which is generally in excess of 0.4 weight percent. The carburization procedure will often increase the carbon content at the surface of the part to a level of greater than 0.5 weight percent. For instance, conventional carburization procedures frequently lead to carbon levels at the surface of the part which are within the range of 0.8 weight percent to 1 weight percent. However, it is normally desirable to limit the carbon content at the surface of the part to a maximum of about 0.9 weight percent because higher carbon contents can lead to retained austenite and brittle martensite. The metal part being carburized can be made by any procedure. For instance, it can be made by casting, forging, machining, or can be a green or sintered powder metal part.

In the first step of the process of this invention the metal article being carburized is heated to an elevated temperature. Any means for heating the metal part can be used. For example, the metal part can be heated in an oven to the desired temperature which will be at least about 50° F. (28° C.) higher than the boiling point of the organic or inorganic liquid used to suspend the graphite employed in carburizing the part. The metal part will typically be heated to a temperature which is at least about 100° F. (56° C.) higher than the boiling point of the organic or inorganic liquid. The metal part will preferably be heated to a temperature which is at least about 125° F. (69° C.) higher than the boiling point of the organic or inorganic liquid. The metal part will more preferably be heated to a temperature which is 150° F. (83° C.) to 200° F. (111° C.) higher than the boiling point of the organic or inorganic liquid used to suspend the graphite.

In the next step the heated metal part is coated with a graphite suspension to produce a graphite coated metal article. The graphite suspension used can be a suspension of graphite particles in an organic or inorganic liquid. A wide variety of organic liquids can be used for this purpose. However, the organic liquid will preferably be in the liquid state at room temperature (about 20° C.) and under atmospheric pressure. For instance, the organic liquid can be an aliphatic or aromatic hydrocarbon such as normal-hexane, cyclo-hexane, normal-heptane, iso-heptane, toluene, benzene, or ethyl benzene. A wide variety of alcohols, ketones, aldehydes, and nitrogen containing heterocyclic compounds can also be employed. For instance, methanol, ethanol, n-propyl alcohol, isopropyl alcohol or a mixture of such alcohols can be used as the liquid for suspending the graphite. In many cases, it will be suitable to use water for suspending the graphite. Water offers the advantage of being inexpensive and environmentally friendly. The graphite suspension will typically contain from about 5 weight percent to about 50 weight percent graphite and will more typically contain from about 10 weight percent to about 40 weight percent graphite. It is typically preferred for the graphite suspension to contain from 15 weight percent to 25 weight percent graphite.

In coating the heated metal part the graphite containing liquid suspension is simply brought into contact with the heated metal part. This can be accomplished utilizing a wide variety of procedures. For instance, the graphite containing liquid suspension can be sprayed, brushed, or rolled onto the heated metal part. However, it is often convenient to simply immerse the heated metal part in a bath of the liquid graphite suspension for a relatively short period of time which is typically within the range of 2 to 30 seconds. In any case, boiling occurs at the surface of the part because the metal part is at a temperature well above the boiling point of the liquid. This leaves a relatively uniform graphite deposit on the surface of the part.

After the metal article has been coated with the graphite it is heat treated under a non-oxidizing environment at a temperature that is sufficient to promote the diffusion of carbon into the metal structure of the article. The temperature utilized will typically be within the range of about 1550° F. (843° C.) to about 2450° F. (1343° C.) and will more typically be within the range of about 1650° F. (899° C.) to about 2100° F. (1149°). In cases where the part being carburized is a green powder metal part it is convenient for the heat treatment to be carried out at a temperature which is sufficient to sinter the powder metal article. After the carbon has diffused into the outer surface layer of the article to the desired degree the heat treating step is terminated and the carburized metal article is cooled to ambient temperature.

After the metal article has been carburized utilizing the technique of this invention it can optionally be further carburized utilizing a conventional carburization technique such as gas carburization, plasma carburization, salt bath carburization, or liquid carburization, to further increase the carbon content of the steel near the surface of the article and/or to increase the depth of carbon penetration. In the alternative, a steel article can initially be partially carburized utilizing a conventional carburization technique with the technique of this invention being used to attain the ultimate level of carburization desired.

This invention is illustrated by the following examples that are merely for the purpose of illustration and are not to be regarded as limiting the scope of the invention or the manner in which it can be practiced. Unless specifically indicated otherwise, parts and percentages are given by weight.

Example 1

A powder metal mix was prepared by mixing a 4200 steel powder with 0.3% graphite and 0.75% ethylene-bis-stearamid. Using this mix, spur gears approximately 1.3"OD×0.6"ID×1.6" long (4.1 cm long having an outside diameter of 3.3 cm and an inside diameter of 1.5 cm) were molded at about 40 tons per square inch (552 megapascals) to a density of 6.6 g/cc. Gears were then sintered at 2050° F. (1121° C.) for about 30 minutes in a nitrogen-hydrogen atmosphere containing 10% hydrogen ($N_2$/10% $H_2$ atmosphere). Sintered gears were coated with graphite by heating them to 250° F. (121° C.) and dipping them into an ultrasonically agitated slurry of 20% graphite in isopropyl alcohol that was at room temperature (about 20° C.). The particle size of the graphite was less than 1 micron and the dipping time was six seconds. The part was re-sintered for about 35 minutes at 2050° F. (1121° C.) in a $N_2$/10% $H_2$ atmosphere. The results attained are presented in Table I.

Example 2

A powder metal spur gear was produced and sintered as in Example 1. Sintered gears were coated with graphite by heating them to 475° F. (246° C.) and dipping them into a mechanically agitated slurry of 22% graphite in water that was at room temperature. Particle size of the graphite was less than 1 micron and the dipping time was six seconds. The part was dried and re-sintered for about 35 minutes at 2050° F. (1121° C.) in a $N_2$/10% $H_2$ atmosphere. The results attained are reported in Table I.

Example 3

The 4200 steel-0.3 graphite mix from Example 1 was molded to a density of 6.6 g/cc and coated in the green condition with graphite by dipping a part heated to 475° F. (246° C.) into a 22% water-base slurry of <1-micron graphite (graphite having a particle size of less than 1 micron) for 6 seconds without agitation. The part was sintered for about 35 minutes at 2050° F. (1121° C.) in a $N_2$/10% $H_2$ atmosphere. The results attained are shown in Table I.

Example 4

A powder metal spur gear was molded to a density of 6.9 g/cc using the 4200 steel-0.3Graphite mix from Example 1. It was sintered at 2050° F. (1121° C.) for 30 minutes in a $N_2$/10% $H_2$ atmosphere. The sintered part was then heated to 250° F. (121° C.) and dipped for 4 seconds without agitation into a 20% slurry of <1-micron graphite in isopropyl alcohol that was at room temperature. It was re-sintered at 2050° F. (1121° C.) for about 30 minutes in a $N_2$/10% $H_2$ atmosphere. The results attained are presented in Table I.

Example 5

A mix consisting of 4600 steel powder-0.2Graphite-0.75 ethylene-bis-stearamid was molded to a density of 6.8 g/cc. It was sintered at 2080° F. (1138° C.) for 30 minutes in a $N_2$/10% $H_2$ atmosphere. The sintered part was subsequently dipped in a slurry of 7-micron graphite in methanol and powder forged. The forging step served to densify the part to 7.8 g/cc. A thin layer of the graphite coating remained on the surface after power forging. The part was re-sintered at 2150° F. (1177° C.) for 30 minutes in a $N_2$/10% $H_2$ atmosphere. It was subsequently reheated to 1600° F. (871° C.), oil quenched, and tempered at 400° F. (204° C.). The results attained are reported in Table I.

Example 6

A 4200 steel-0.2 graphite-0.75 ethylene-bis-stearamid mix was warm molded at 300° F. (149° C.) to 6.9 g/cc. The part was transferred directly from the warm molding press to a 20% slurry of <1-micron graphite in isopropyl alcohol and held for six seconds. The part was sintered at 2050° F. (1121° C.) for 30 minutes in a $N_2$/10% $H_2$ atmosphere. The results attained are shown in Table I.

Example 7

A 4400 steel-0.75 ethylene-bis-stearamid mix was molded to 7.1 g/cc, pre-sintered at 1500° F. (816° C.) and repressed to a density of 7.45 g/cc using a <1-micron graphite slurry in water as the sizing lubricant. The parts were then sintered at 2300° F. (1260° C.). The results attained are presented in Table I.

Example 8

A powder metal spur gear was produced and sintered as in Example 1. Sintered gears were coated with graphite by heating gears to 270° F. (132° C.) and dipping them for 8 seconds into a 15% slurry of <1-micron graphite in isopropyl alcohol. The part was dried and re-sintered for about 35 minutes at 2050° F. (1121° C.) in a $N_2$/10% $H_2$ atmosphere. After sintering, the part was subjected to a conventional hardening heat treatment by austenitizing at about 1600° F. (871° C.), oil quenching and tempering at 400° F. (204° C.). The results attained are reported in Table I.

Example 9

A powder metal spur gear was produced and sintered as in Example 1. It was heated to 275° F. (135° C.) and then painted with a 15% suspension of <1-micron graphite in isopropyl alcohol using a brush. The part was dried, and then sintered for about 35 minutes at 2050° F. (1121° C.) in a $N_2$/10% $H_2$ atmosphere. The results attained are shown in Table I.

Example 10

A powder metal spur gear was produced and sintered as in Example 1. It was heated to 250° F. (121° C.) and then spray painted with a 22% suspension of <1-micron graphite in isopropyl alcohol. The part was dried, and then sintered for about 35 minutes at 2050° F. (1121° C.) in a $N_2$/5% $H_2$ atmosphere. The results attained are presented in Table I.

Example 11

A piece was cut from a ¼ inch wrought 1015 steel rod. It was degreased, heated to 250° F. (121° C.) and immersed in a stirred slurry of <1-micron graphite in isopropyl alcohol for 6 seconds. The rod was then dried and sintered for about 35 minutes at 2050° F. (1121° C.) in a $N_2$/5% $H_2$ atmosphere. The results attained are presented in Table I.

Example 12

A piece was cut from a wrought 8620 steel bar. It was degreased, heated to 250° F. (121° C.) and immersed in a stirred slurry of <1-micron graphite in isopropyl alcohol for 6 seconds. The rod was then dried and sintered for about 35 minutes at 2050° F. (1121° C.) in a $N_2$/5% $H_2$ atmosphere. The results attained are reported in Table I.

TABLE I

RESULTS OF SOLID STATE CARBURIZING

| Example | Density (g/cc) | Condition | Apparent Hardness | % Surface Carbon | Case Thickness (inches) |
|---|---|---|---|---|---|
| 1 | 6.6 | Sintered | B70 | 1.329 | 0.045 |
| 2 | 6.6 | Sintered | B59 | 0.842 | 0.035 |
| 3 | 6.6 | Green | B39 | 1.002 | 0.035 |
| 4 | 6.9 | Green | B67 | 1.000 | NA |
| 5 | 7.8 | Powder Forged | C57 | — | 0.010 |
| 6 | 6.9 | Warm Molded | B97 | 0.944 | 0.030 |
| 7 | 7.45 | DP/DS** | B97 | NA | 0.008 |
| 8 | 6.6 | Sintered | RC63* | NA | 0.025 |
| 9 | 6.6 | Sintered | B80 | 1.402 | 0.045 |
| 10 | 6.6 | Sintered | B70 | 0.810 | 0.035 |
| 11 | 7.85 | Wrought | B79 | 0.475 | 0.045 |
| 12 | 7.85 | Wrought | B102 | — | 0.050 |

*Particle Hardness

**DP/DS = Double Press/Double Sinter Process

While certain representative embodiments and details have been shown for the purpose of illustrating the subject invention, it will be apparent to those skilled in this art that various changes and modifications can be made therein without departing from the scope of the subject invention.

What is claimed is:

1. A process for carburizing a metal article comprising: (1) heating the metal article to an elevated temperature, wherein the metal article is a green powder metal article, (2) coating the heated metal article with a graphite suspension to produce a graphite coated metal article, wherein the graphite suspension is comprised of graphite and an organic or inorganic liquid having a boiling point of at least 50° F. less than the elevated temperature to which the metal article is heated, (3) heat treating the graphite coated metal article under a non-oxidizing environment at a temperature which is sufficient to promote the diffusion of carbon into the metal structure of the article to produce a carburized metal article, and wherein the temperature is sufficient to sinter the powder metal article, and (4) cooling the carburized metal article to ambient temperature; wherein the metal article is heated in step (1) to a temperature which is 50° F. to 200° F. higher than the boiling point of the organic or inorganic liquid.

2. A process as specified in claim 1 wherein the metal is steel having a carbon content of less than 0.4%.

3. A process as specified in claim 2 wherein the carbon content of the steel is less than 0.25%.

4. A process as specified in claim 2 wherein the graphite coated metal article is heat treated in step (3) at a temperature which is within the range of about 1,550° F. to about 2,450° F.

5. A process as specified in claim 2 wherein the graphite coated metal article is heat treated in step (3) at a temperature which is within the range of about 1,650° F. to about 2,100° F.

6. A process as specified in claim 2 wherein the graphite coated metal article is heat treated in step (3) at a temperature which is within the range of about 1,550° F. to about 1,750° F.

7. A process as specified in claim 4 wherein the liquid is an organic liquid.

8. A process as specified in claim 7 wherein the organic liquid is an alcohol.

9. A process as specified in claim 4 wherein the liquid is water.

10. A process as specified in claim 2 wherein the boiling point of the liquid is at least 125° F. less than the temperature to which the metal article is heated in step (1).

11. A process as specified in claim 2 wherein the boiling point of the liquid is at least 150° F. less than the temperature to which the metal article is heated in step (1).

12. A process as specified in claim 2 wherein the non-oxidizing environment is an inert, neutral, or reducing atmosphere.

13. A process as specified in claim 2 wherein the non-oxidizing environment is a vacuum.

14. A process as specified in claim 2 wherein the non-oxidizing environment is comprised of a mixture of carbon monoxide and carbon dioxide.

15. A process as specified in claim 2 wherein the non-oxidizing environment is comprised of a mixture of methane and hydrogen.

16. A process as specified in claim 1 wherein the metal article is heated in step (1) to a temperature which is 150° F. to 200° F. higher than the boiling point of the organic or inorganic liquid.

17. A process as specified in claim 1 wherein the metal article has an initial carbon content which is within the range of 0.1 weight percent to 0.3 weight percent.

18. A process as specified in claim 1 wherein the graphite suspension consists of (a) about 10 weight percent to about 40 weight percent graphite and (b) the organic or inorganic liquid.

19. A process for carburizing a metal article comprising: (1) heating the metal article to an elevated temperature, (2) coating the heated metal article with a graphite suspension to produce a graphite coated metal article, wherein the graphite suspension consists of graphite and at least one organic or inorganic liquid having a boiling point of at least 50° F. less than the elevated temperature to which the metal article is heated, (3) heat treating the graphite coated metal article under a non-oxidizing environment at a temperature which is sufficient to promote the diffusion of carbon into the metal structure of the article to produce a carburized metal article, and (4) cooling the carburized metal article to ambient temperature; wherein the metal article is heated in step (1) to a temperature which is 50° F. to 200° F. higher than the boiling point of the organic or inorganic liquid.

20. A process as specified in claim 19 wherein the metal article coated in step (1) is a green powder metal article, wherein the green metal article is comprised of steel having a carbon content of less than 0.4%, and wherein the heat treatment is carried out at a temperature sufficient to sinter the powder metal article.

* * * * *